US010982894B2

(12) United States Patent
Hong et al.

(10) Patent No.: US 10,982,894 B2
(45) Date of Patent: Apr. 20, 2021

(54) ICE STORAGE

(71) Applicant: COWAY CO., LTD., Chungcheongnam-do (KR)

(72) Inventors: Young-Hoon Hong, Seoul (KR); Jung-Hwan Lee, Seoul (KR); Hyun-Seok Moon, Seoul (KR); Kyu-Jun Kim, Seoul (KR); Gyeong-Min Lee, Seoul (KR); Jong-Min Kim, Seoul (KR); Han-Soo Kim, Seoul (KR); Dong-Min Oh, Seoul (KR)

(73) Assignee: Coway Co., Ltd

( * ) Notice: Subject to any disclaimer, the term of this patent is extended or adjusted under 35 U.S.C. 154(b) by 327 days.

(21) Appl. No.: 16/305,662

(22) PCT Filed: Jun. 1, 2017

(86) PCT No.: PCT/KR2017/005744
§ 371 (c)(1),
(2) Date: Nov. 29, 2018

(87) PCT Pub. No.: WO2017/209543
PCT Pub. Date: Dec. 7, 2017

(65) Prior Publication Data

US 2020/0278144 A1 Sep. 3, 2020

(30) Foreign Application Priority Data

Jun. 2, 2016 (KR) ..... 10-2016-0069021

(51) Int. Cl.
*F25C 5/182* (2018.01)

(52) U.S. Cl.
CPC ..... *F25C 5/182* (2013.01)

(58) Field of Classification Search
CPC ..... F25C 5/182; F25C 5/185; F25C 5/005; F25C 5/20; F25C 5/00; F25C 5/02;
(Continued)

(56) References Cited

U.S. PATENT DOCUMENTS 2,724,949 A * 11/1955 Kattis ..... F25C 1/142 62/137
5,056,688 A * 10/1991 Goetz ..... F25C 5/22 222/146.6

(Continued)

FOREIGN PATENT DOCUMENTS

CN 1858524 11/2006
CN 101529174 9/2009

(Continued)

OTHER PUBLICATIONS

PCT/ISA/210 Search Report issued on PCT/KR2017/005744 pp. 5.

(Continued)

*Primary Examiner* — Emmanuel E Duke
(74) *Attorney, Agent, or Firm* — The Farrell Law Firm, P.C.

(57) ABSTRACT

An ice storage includes a storage body having a storage space for storing ice and a discharge port for discharging ice to the outside, a transferring and breaking part which, by having at least a part thereof provided in the storage space, transfers the ice in the storage space to the discharge port, and if necessary, breaks the transferred ice, and a door part allowing the ice to be discharged through the discharge port as unbroken ice or broken ice unbroken or broken up by the transferring and breaking part. The transferring and breaking part includes a transferring member for transferring ice and a breaking member for breaking ice, and the transferring member and the breaking member are configured such that ice is not stuck therebetween while being transferred.

18 Claims, 11 Drawing Sheets

(58) Field of Classification Search
CPC .... F25C 5/046; F25C 5/12; F25C 1/24; F25C 5/04; F25C 5/18; B65G 33/26; B65G 33/10; F25D 23/02; F25D 11/00; F16D 13/00
See application file for complete search history.

(56) References Cited

U.S. PATENT DOCUMENTS

| | | | | |
|---|---|---|---|---|
| 6,109,476 | A * | 8/2000 | Thompson | F25C 5/046 222/1 |
| 2006/0213213 | A1 | 9/2006 | Chung et al. | |
| 2006/0248912 | A1 | 11/2006 | Park et al. | |
| 2010/0313593 | A1 | 12/2010 | Lee et al. | |
| 2013/0174596 | A1* | 7/2013 | Kim | F25C 5/00 62/320 |
| 2015/0354883 | A1* | 12/2015 | Bauriedl | F25C 5/046 62/320 |

FOREIGN PATENT DOCUMENTS

| | | |
|---|---|---|
| CN | 1837720 | 12/2010 |
| EP | 1 705 438 | 9/2006 |
| KR | 1020060112884 | 11/2006 |
| KR | 1020060115306 | 11/2006 |
| KR | 1020090133021 | 12/2009 |
| KR | 1020140049845 | 4/2014 |
| KR | 1020160041881 | 4/2016 |
| WO | WO 2008/050991 | 5/2008 |

OTHER PUBLICATIONS

PCT/ISA/237 Written Opinion issued on PCT/KR2017/005744 pp. 8.
European Search Report dated Apr. 26, 2019 issued in counterpart application No. 17807036.3-1009, 7 pages.
Chinese Office Action dated May 14, 2020 issued in counterpart application No. 201780032812.6, 9 pages.

* cited by examiner

【Figure 1】
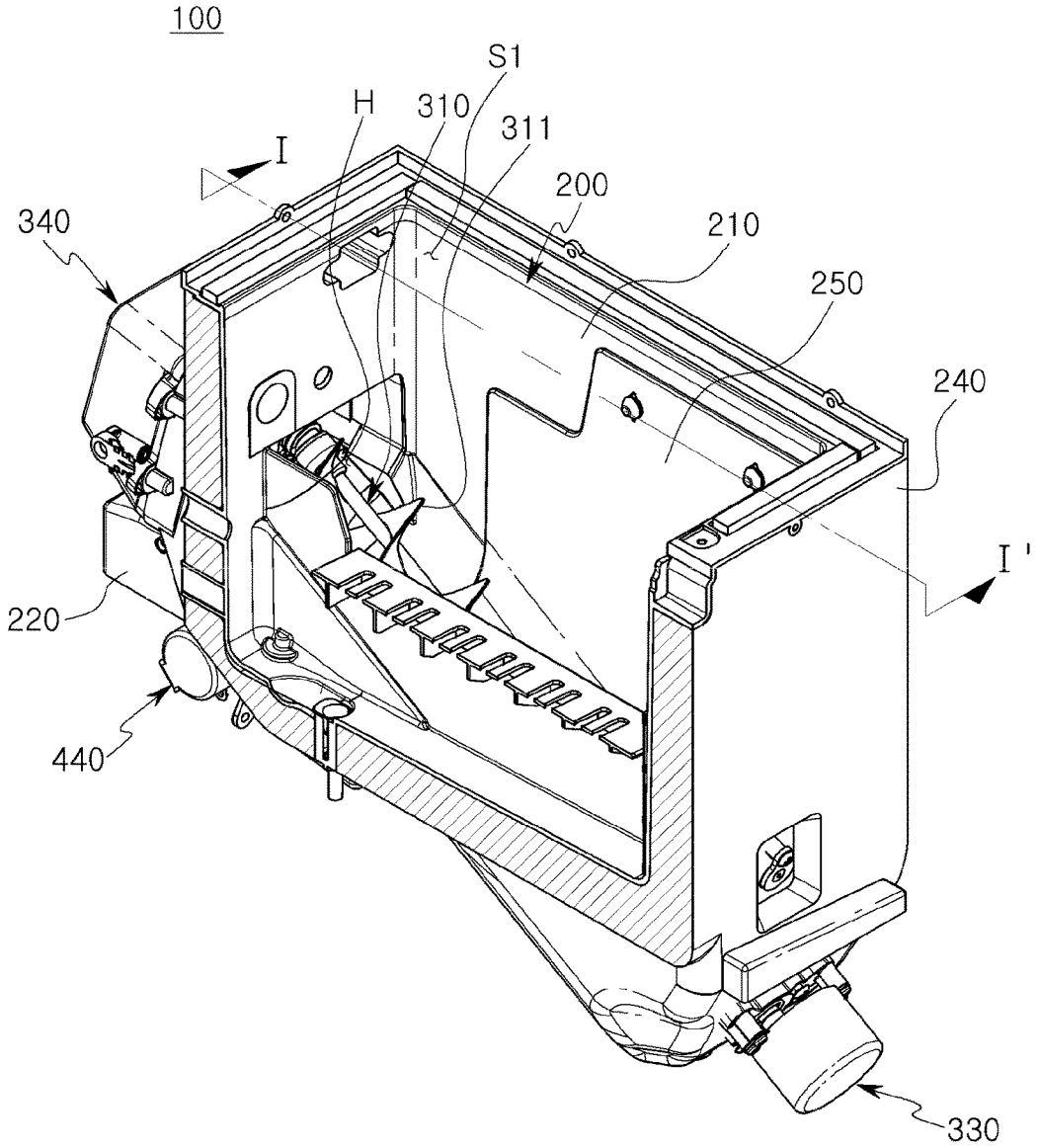

【Figure 2】
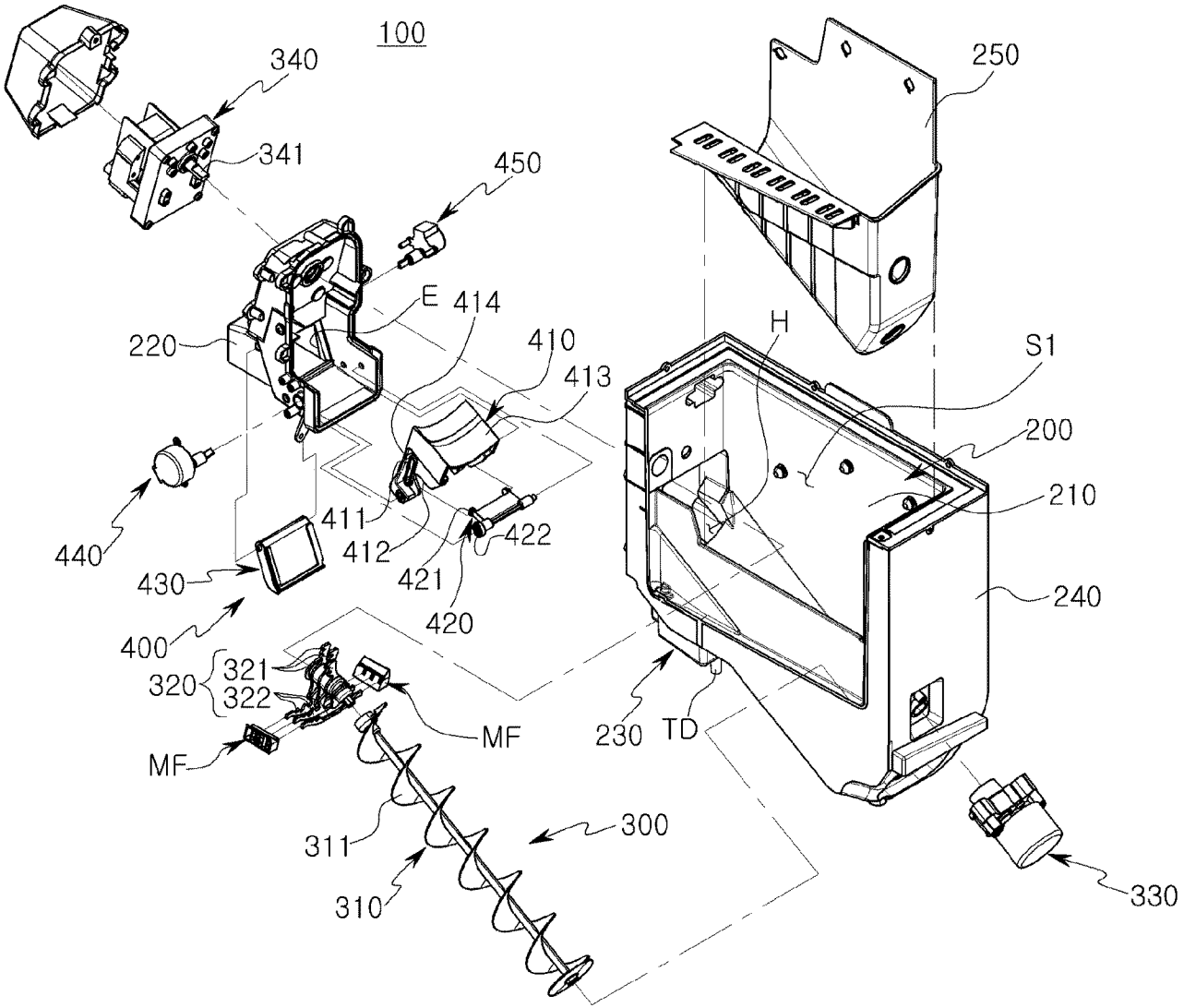

【Figure 3】
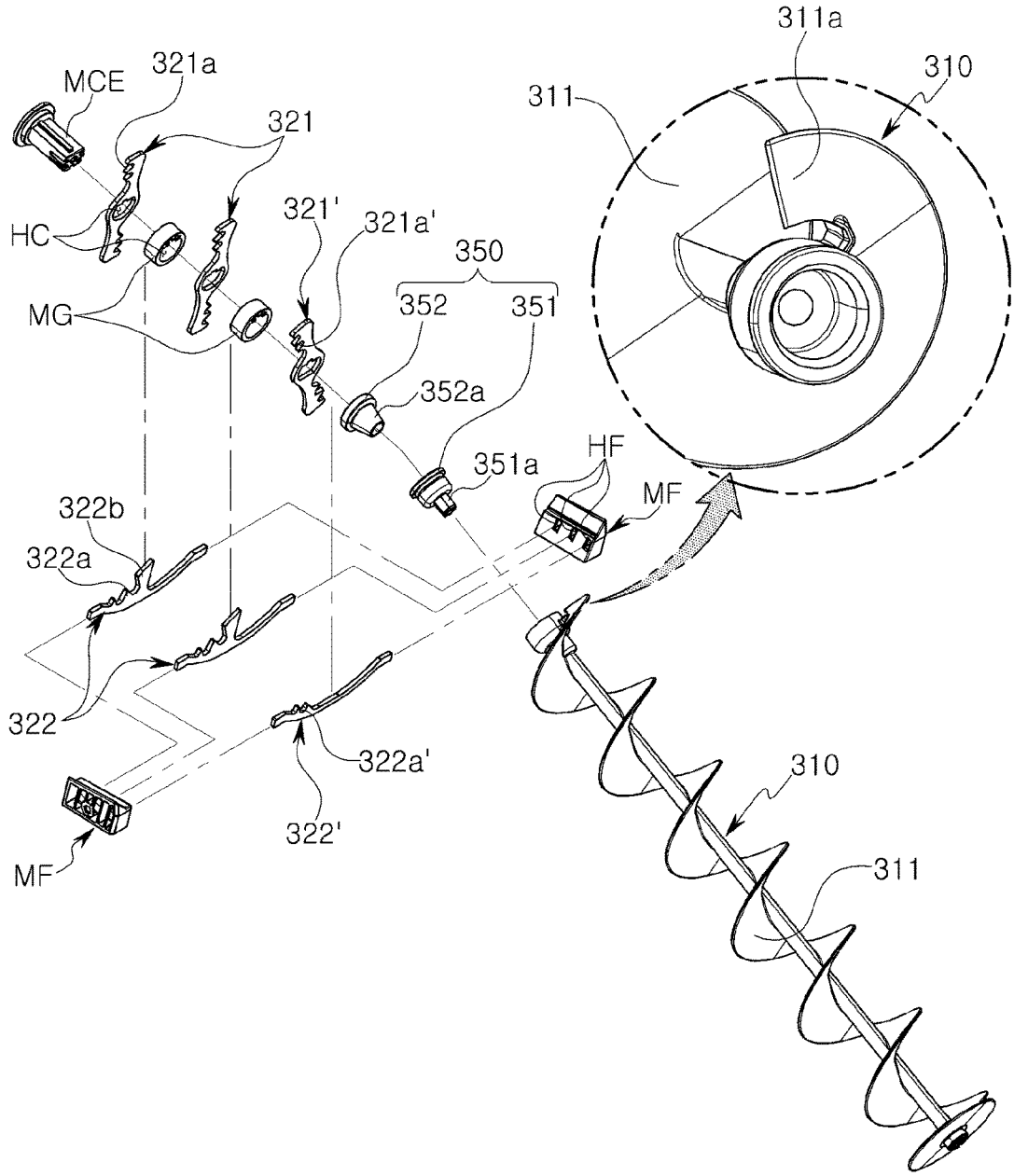

【Figure 4】
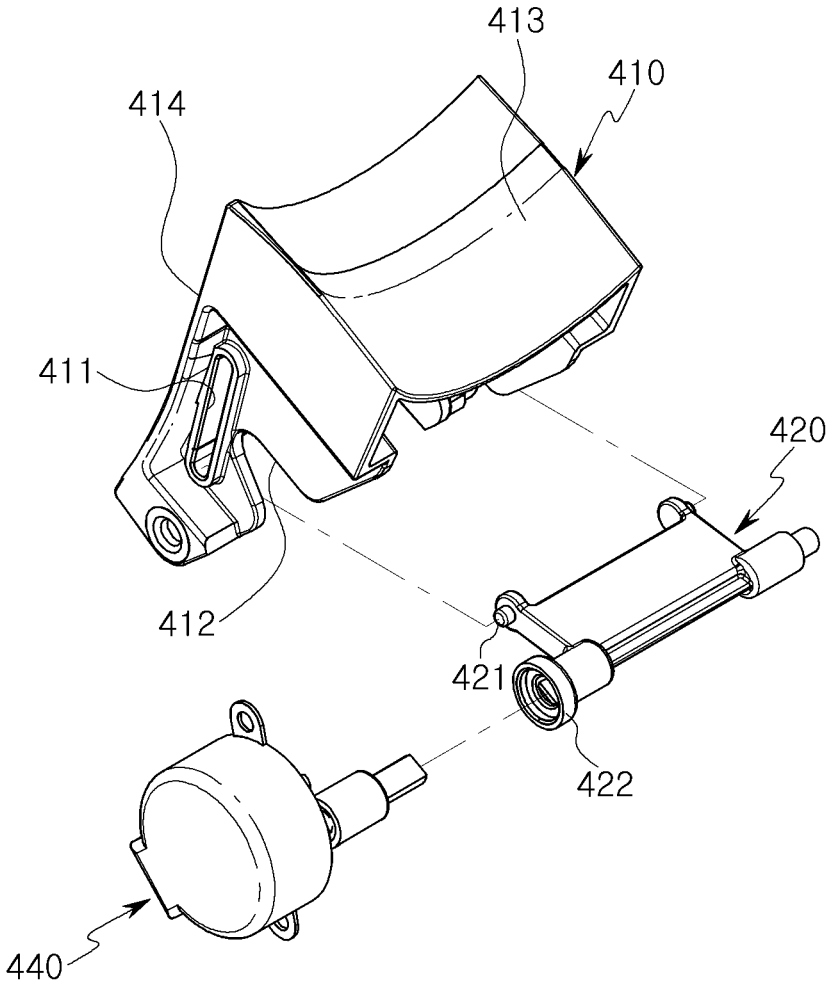

【Figure 5】
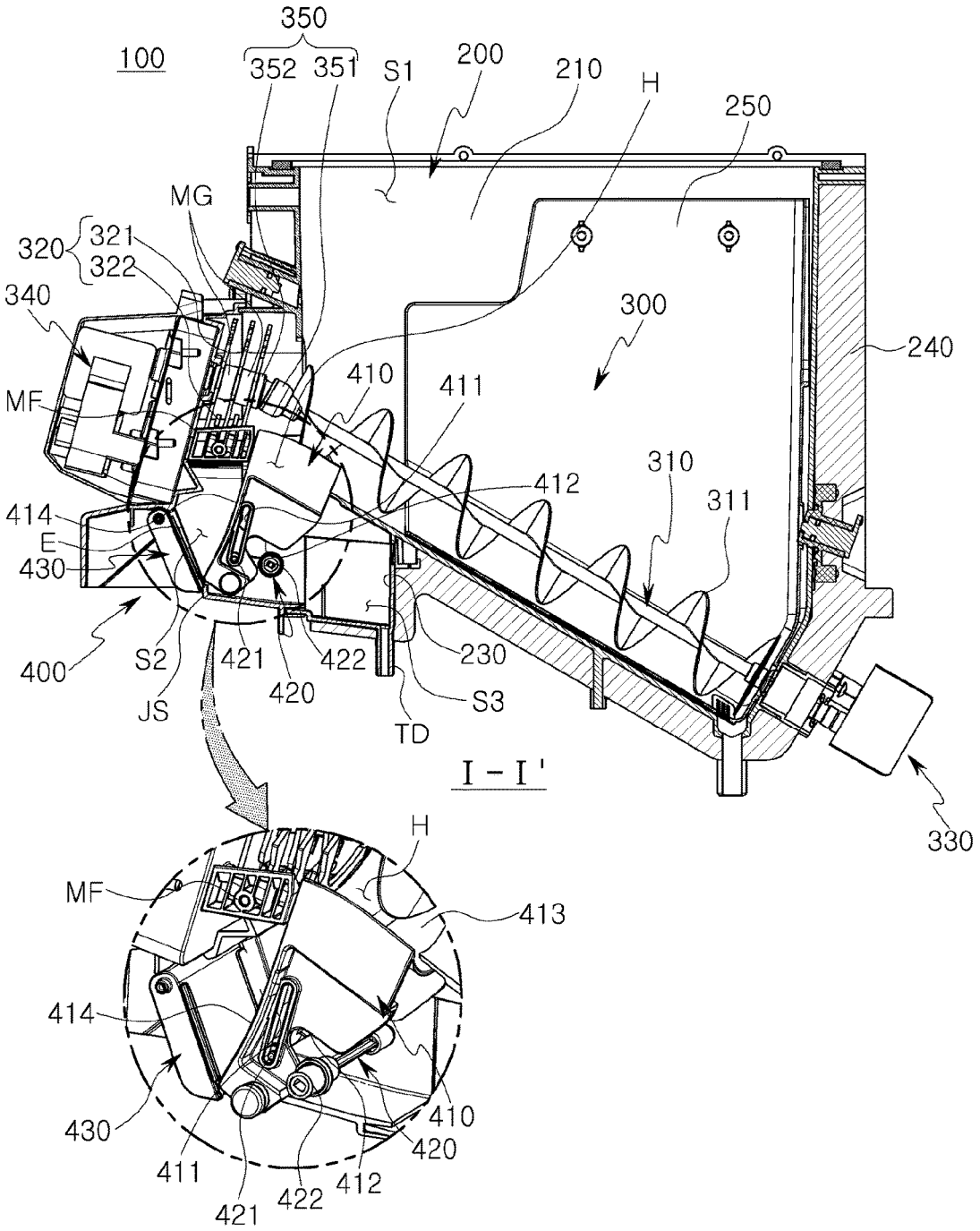

【Figure 6】
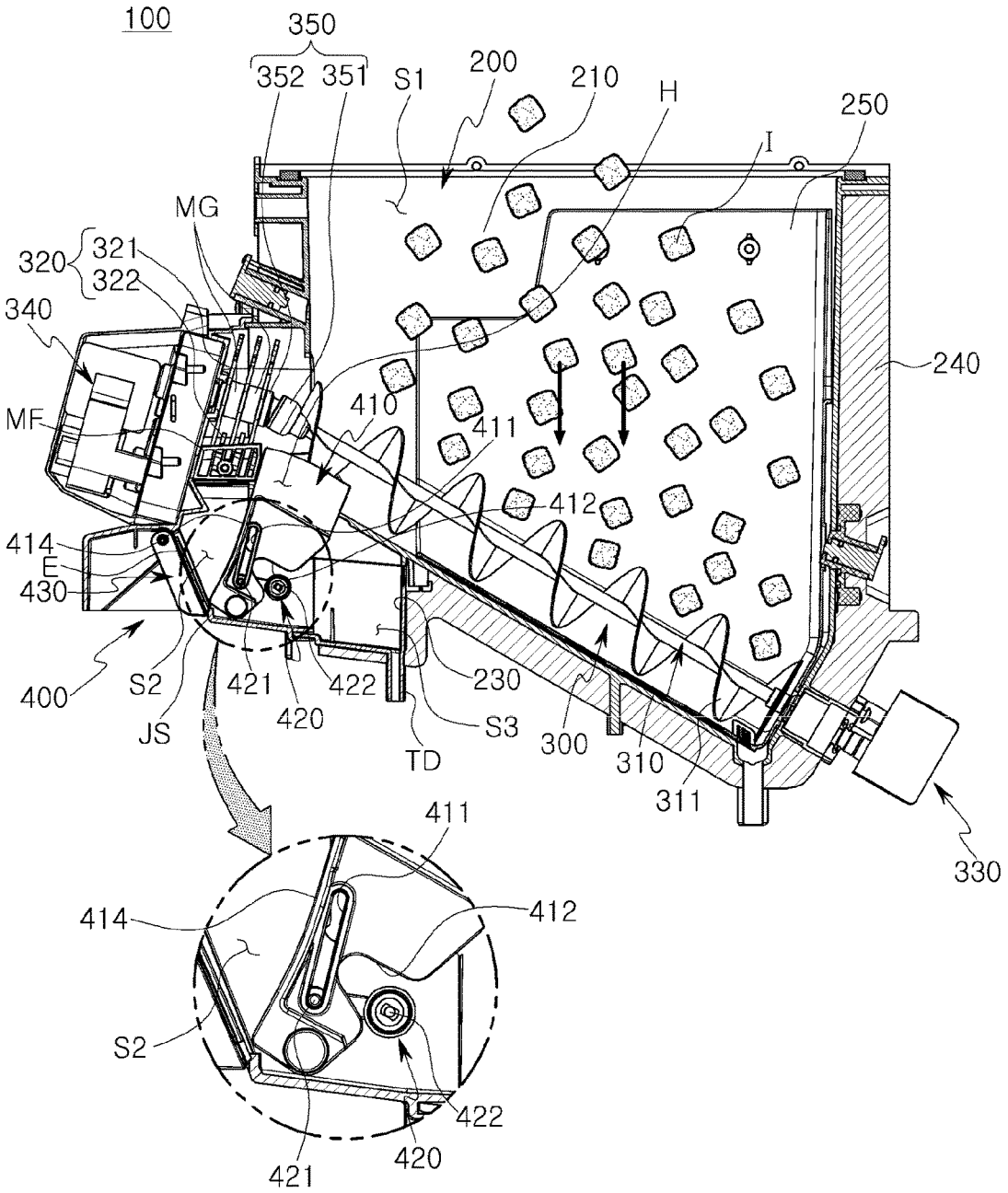

【Figure 7】
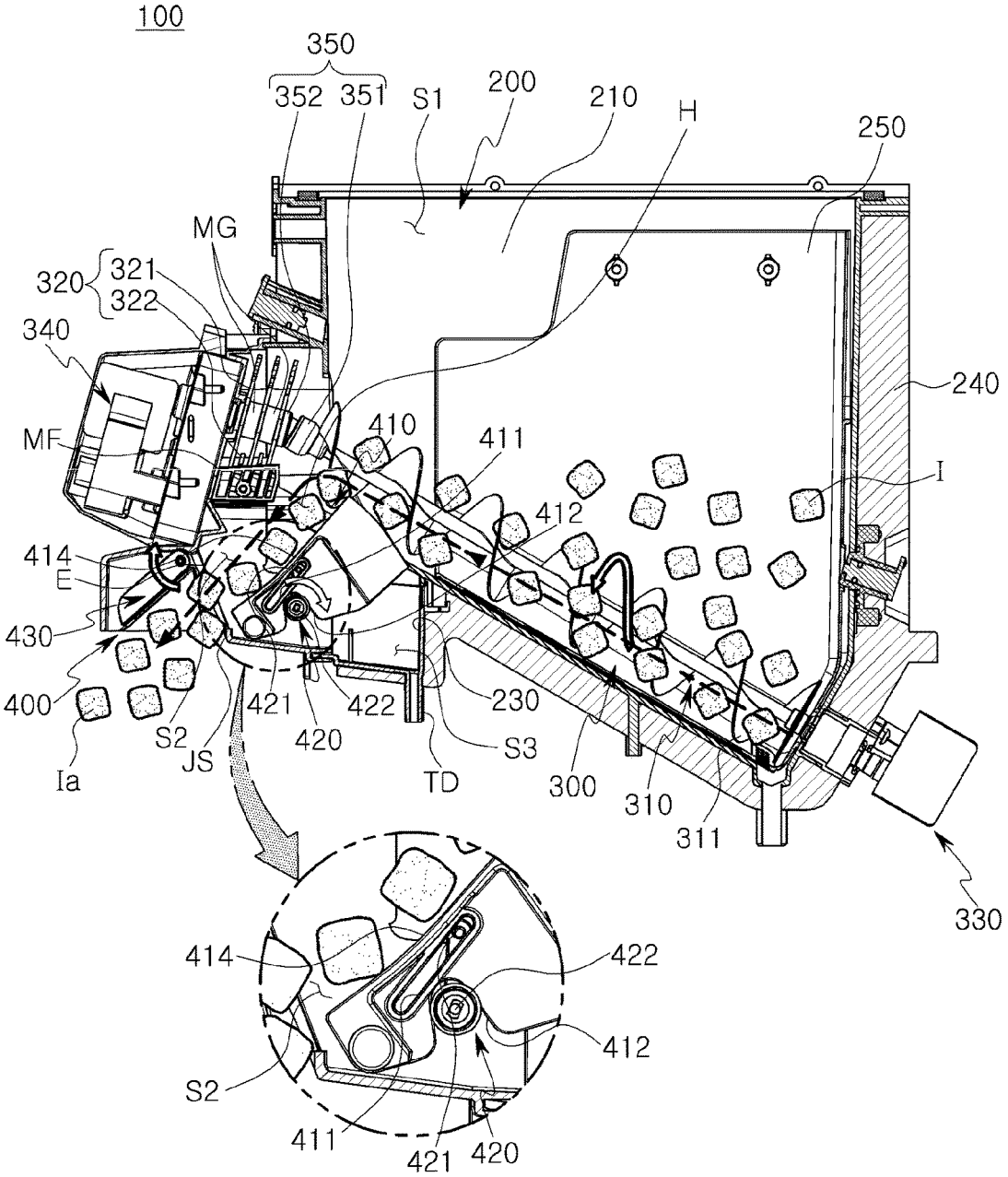

【Figure 8】
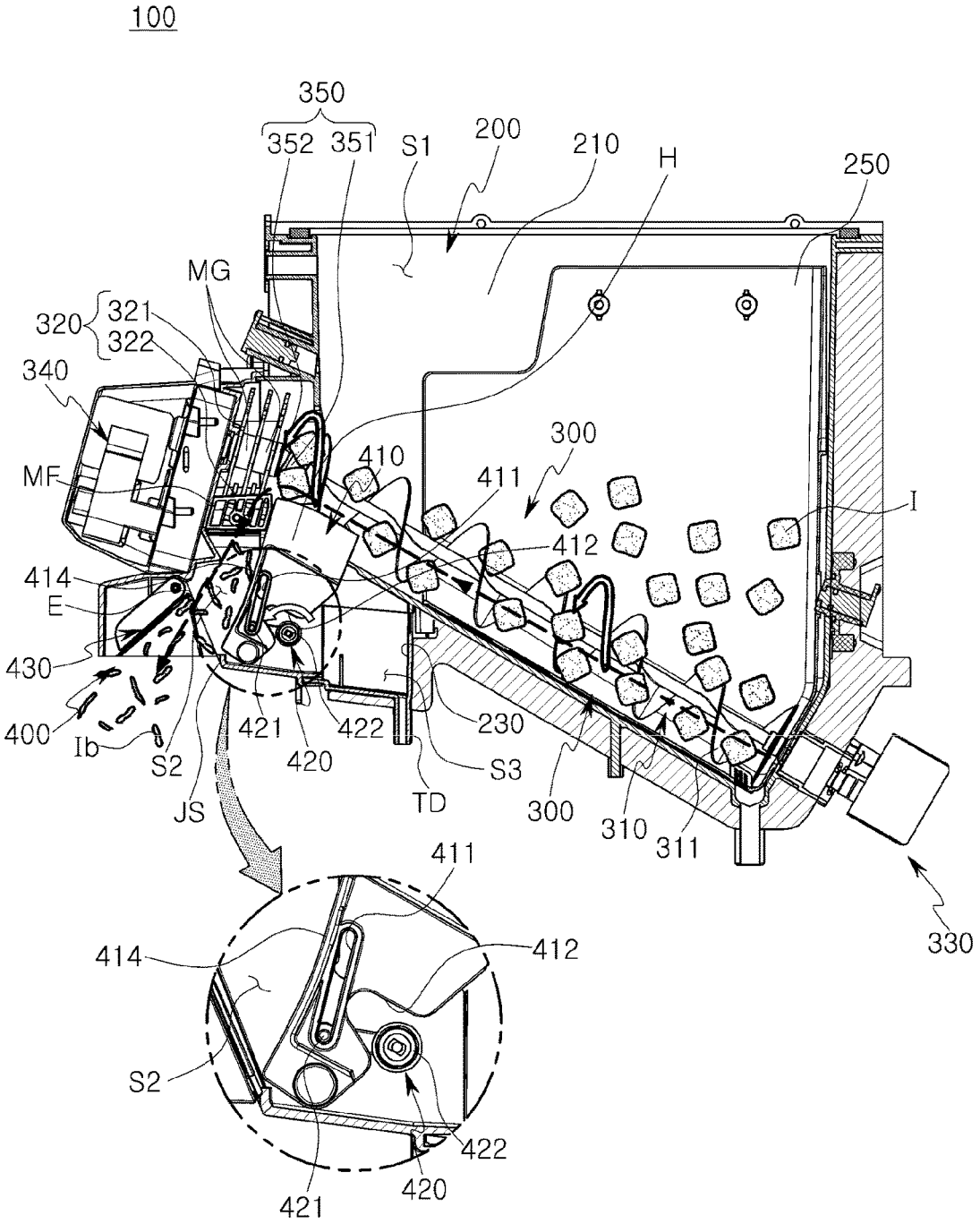

【Figure 9】
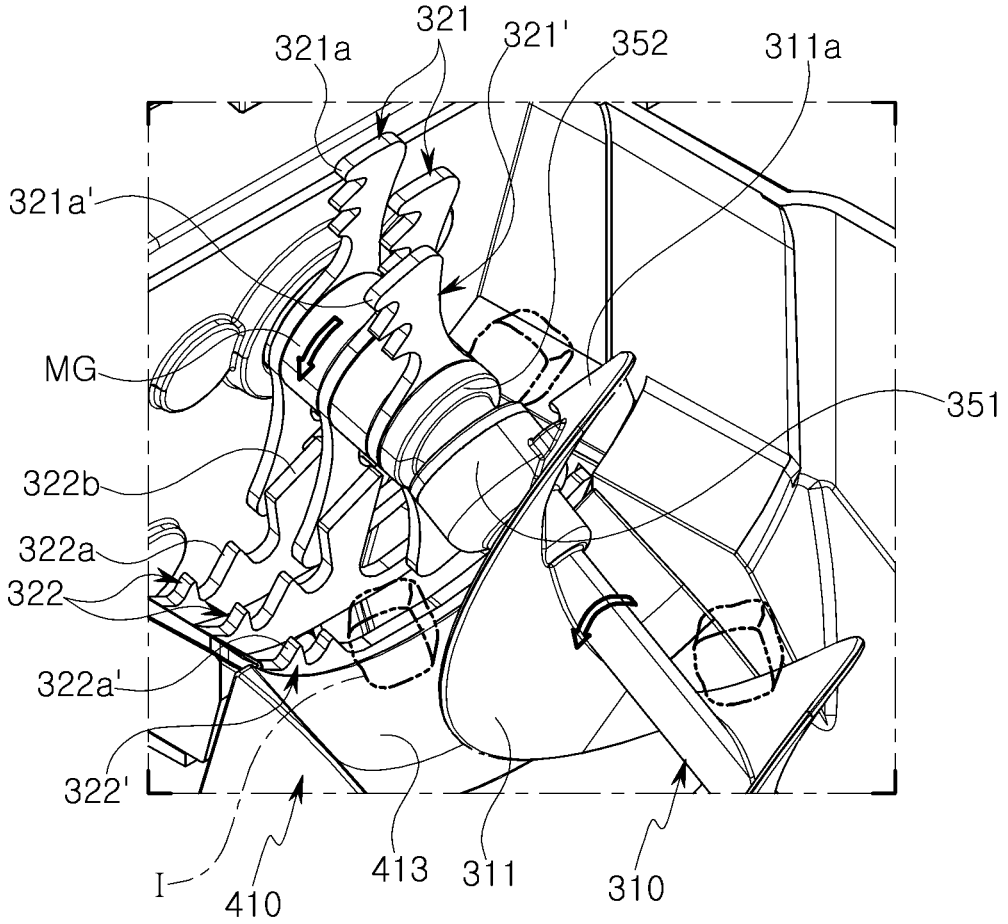

【Figure 10】
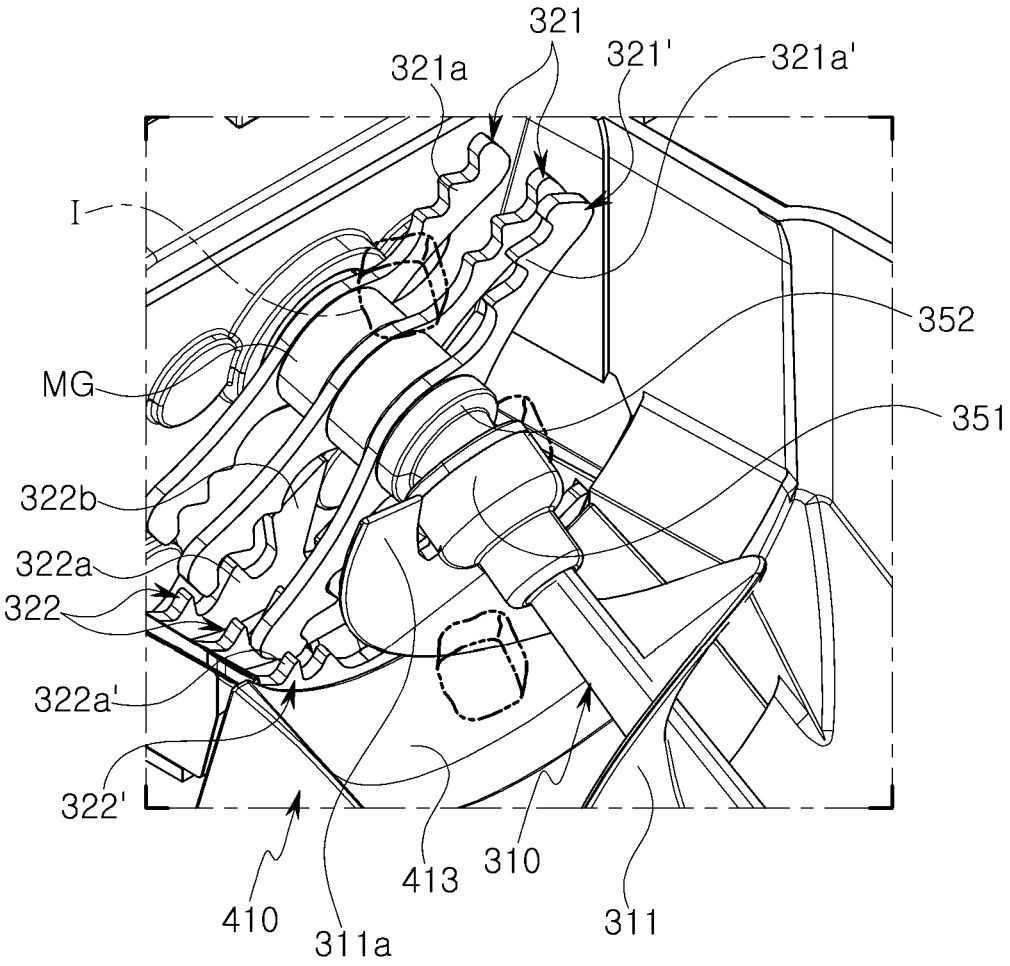

【Figure 11】
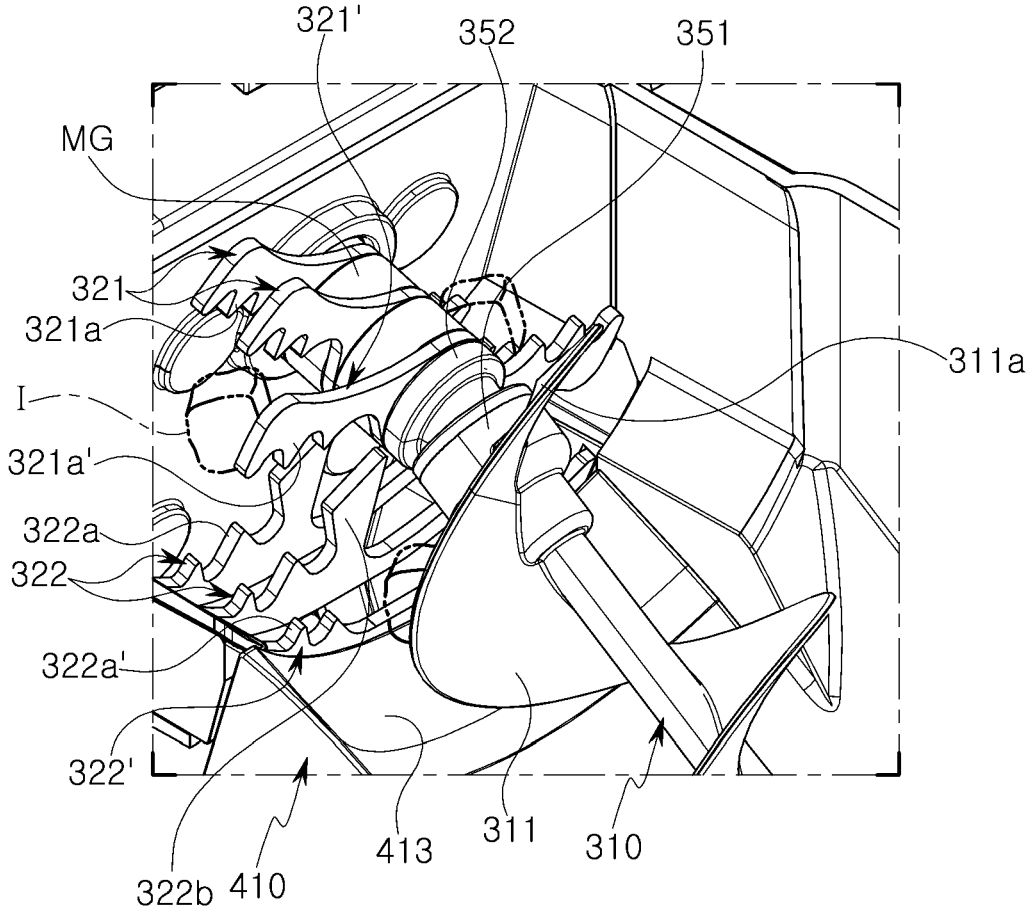

ICE STORAGE

PRIORITY

This application is a National Phase Entry of International Application No. PCT/KR2017/005744, which was filed on Jun. 1, 2017, and claims priority to Korean Patent Application No. 10-2016-0069021, which was filed on Jun. 2, 2016, the content of each of which is incorporated herein by reference.

TECHNICAL FIELD

The present disclosure relates to an ice storage storing ice, discharging the stored ice externally, and supplying the ice to a user.

BACKGROUND ART

An ice storage is supplied with ice made in an ice maker and stores the ice, and discharges the ice externally to supply the ice to a user.

Such an ice storage is provided in a refrigerator or a water purifier with an ice maker. An ice storage stores the ice made in an ice maker provided in a refrigerator or a water purifier, and discharges the stored ice to the outside and supplies the ice to a user.

To this end, an ice storage has a transferring member for transferring stored ice to a discharge port to discharge the ice to the outside through the discharge port.

The ice stored in an ice storage is discharged to the outside through the discharge port as it is without being processed, as unbroken ice, for example. Recently, an ice storage has also broken the ice stored therein and discharged the broken ice to the outside through the discharge port.

In the case in which the ice storage breaks ice and discharges the broken ice to the outside, the ice storage has a breaking member for breaking ice, in addition to the transferring member, and the ice transferred by the transferring member is broken up by the breaking member.

In an ice storage disclosed in the related art, the ice transferred by the transferring member may become stuck between the transferring member and the breaking member. If ice becomes stuck between the transferring member and the breaking member as above, to transfer and break the ice, a rotational unit for rotating the transferring member and the breaking member independently or together, and the like, for example, may be under heavy load to operate, may stop operating, or the rotational unit may be broken. Accordingly, the operations of transferring and breaking ice may not be smoothly performed or may stop.

DISCLOSURE

Technical Problem

Aspects of the present disclosure are to address at least one of the above demands or issues occurring in the related art.

An aspect of the present disclosure is to smoothly perform transferring and breaking of ice without suspension.

Another aspect of the present disclosure is to prevent ice transferred by a transferring member from becoming stuck between the transferring member and the breaking member for breaking ice.

Another aspect of the present disclosure is to significantly reduce remaining ice not transferred by the transferring member.

Technical Solution

According to an aspect of the present disclosure, an ice storage according to an exemplary embodiment includes features as below.

According to an aspect of the present disclosure, an ice storage includes a storage body having a storage space in which ice is stored and a discharge port through which ice is discharged externally, a transferring and breaking part of which at least a portion is in the storage space, the transferring and breaking part transferring the ice in the storage space to the discharge port and breaking the transferred ice as required, and a door part allowing the ice to be discharged through the discharge port as unbroken ice or broken ice unbroken or broken up by the transferring and breaking part. The transferring and breaking part includes a transferring member transferring ice and a breaking member breaking ice, and the transferring member and the breaking member are configured such that ice is prevented from being stuck therebetween while being transferred.

In this case, the breaking member may be disposed subsequent to the transferring member in a discharge port direction in the storage space to allow the ice transferred by the transferring member to be broken up by the breaking member.

The transferring member may rotate to allow the ice in the storage space to be transferred to the discharge port.

The transferring member may have a transferring wing, and the transferring wing may have an elastic transformable part bendable by external force applied by ice present between the transferring member and the breaking member on an end of the transferring wing positioned near the discharge port.

The transferring wing may be extended to an end of the transferring member positioned near the discharge port.

The elastic transformable part may be formed as the end of the transferring wing positioned near the discharge port is separated from the transferring member by a certain length.

The transferring wing may have a spiral shape.

The breaking member may include a rotatable breaking member rotating, and a fixed breaking member provided to be fixed to the storage body to break ice along with the rotatable breaking member.

The fixed breaking member may be configured such that a plurality of the fixed breaking members are provided in the storage body with certain gaps.

Among the plurality of fixed breaking members, an outermost fixed breaking member positioned most closely to the transferring member may be configured to prevent ice from being stuck between the outermost fixed breaking member and the transferring member.

The fixed breaking member other than the outermost fixed breaking member may have a fixed breaking wing breaking ice, and an escape prevention part preventing ice from escaping while the ice is broken up by the fixed breaking member, and the outermost fixed breaking member may only have the fixed breaking wing therein.

The fixed breaking wing may be configured such that a plurality of the fixed breaking wings are formed in order from one end of the fixed breaking member in a length direction of the fixed breaking member.

The escape prevention part may be formed subsequent to the plurality of fixed breaking wings in a length direction of the fixed breaking member.

The escape prevention part may be larger than the fixed breaking wing.

A central portion of the outermost fixed breaking member may have a height lower than heights of central portions of the other fixed breaking members.

The rotatable breaking member may rotate by a breaking and rotating unit.

The rotatable breaking member may be configured such that a plurality of the rotatable breaking members are connected to one another with certain gaps in a breaking and rotating shaft included in the breaking and rotating unit to respectively pass through spaces among the plurality of fixed breaking members, and rotate.

The rotatable breaking member may have a rotatable breaking wing breaking ice along with the fixed breaking wing.

The rotatable breaking wing may be configured such that a plurality of the rotatable breaking wings are formed in order from one end and the other end of the rotatable breaking member in a length direction of the rotatable breaking member.

Advantageous Effects

As set forth above, according to an exemplary embodiment in the present disclosure, the ice transferred by the transferring member may be prevented from becoming stuck between the transferring member and the breaking member breaking ice.

Also, according to an exemplary embodiment in the present disclosure, the transferring and breaking of ice may not be stopped but may be successfully performed.

Further, according to an exemplary embodiment in the present disclosure, remaining ice not transferred by the transferring member may be significantly reduced.

DESCRIPTION OF DRAWINGS

FIG. 1 is a perspective diagram illustrating an ice storage according to an exemplary embodiment in the present disclosure.

FIG. 2 is an exploded perspective diagram illustrating an ice storage according to an exemplary embodiment in the present disclosure.

FIG. 3 is an exploded perspective diagram illustrating a transferring member and a breaking member of a transferring and breaking part in an ice storage according to an exemplary embodiment in the present disclosure.

FIG. 4 is an exploded perspective diagram illustrating a first door, a first door moving member, a door moving member rotation unit of a door part in an ice storage according to an exemplary embodiment in the present disclosure.

FIG. 5 is a cross-sectional diagram taken along line I-I' in FIG. 1.

FIGS. 6 to 8 are cross-sectional diagrams illustrating an operation of an ice storage according to an exemplary embodiment in the present disclosure as in FIG. 5.

FIGS. 9 to 11 are enlarged perspective diagrams illustrating an operation of breaking up transferred ice in an ice storage according to an exemplary embodiment in the present disclosure.

MODE FOR INVENTION

To help understanding of features of the present invention as above, exemplary embodiments of an ice storage will be described in greater detail.

In the descriptions below, the present disclosure will be described based on the most appropriate exemplary embodiments for understanding of technical features in the present disclosure. It is to be understood that the technical features of the present invention are not limited to the exemplary embodiments, but the present invention may be implemented as in the exemplary embodiments described herein. Thus, the present invention may be modified in various manners through the exemplary embodiments described herein within the technical scope of the present invention, and the modified exemplary embodiments is to be included in the technical scope of the present invention. Also, to help understanding of the exemplary embodiments, as for reference numerals in the attached drawings, relevant elements among elements having the same function in the exemplary embodiments are indicated by the same or similar form of reference numeral.

In the descriptions below, an ice storage will be described with reference to FIGS. 1 to 11 according to exemplary embodiments.

FIG. 1 is a perspective diagram illustrating an ice storage according to an exemplary embodiment. FIG. 2 is an exploded perspective diagram illustrating an ice storage according to an exemplary embodiment.

FIG. 3 is an exploded perspective diagram illustrating a transferring member and a breaking member of a transferring and breaking part in an ice storage according to an exemplary embodiment. FIG. 4 is an exploded perspective diagram illustrating a first door, a first door moving member, a door moving member rotation unit of a door part in an ice storage according to an exemplary embodiment. FIG. 5 is a cross-sectional diagram taken along line I-I' in FIG. 1.

FIGS. 6 to 8 are cross-sectional diagrams illustrating an operation of an ice storage according to an exemplary embodiment as in FIG. 5.

FIGS. 9 to 11 are enlarged perspective diagrams illustrating an operation of breaking transferred ice in an ice storage according to an exemplary embodiment.

An ice storage 100 according to an exemplary embodiment may include a storage body 200, a transferring and breaking part 300, and a door part 400 as illustrated in FIGS. 2 and 5.

Storage Body

In the storage body 200, a storage space S1 and a discharge port E may be formed.

The storage space S1 of the storage body 200 may store ice I. The storage space S1 may have an upper portion opened as illustrated in FIGS. 1, 2, and 5, and the ice I may enter the storage space S1 through the opened upper portion of the storage space S1 and may be stored.

For example, an ice maker (not illustrated) making the ice I may be provided above the storage space S1. The ice I made in the ice maker may drop into the storage space S1 by self-weight, as illustrated in FIG. 6. Accordingly, the ice I may enter the storage space S1 through the opened upper portion of the storage space S1 and may be stored in the storage space S1 as described above.

However, the configuration in which the ice I enters and is stored in the storage space S1 in the storage body 200 is not limited to the exemplary embodiment described above. Any well-known configuration, such as the configuration that a movement path is formed to allow the ice I to move from the ice maker to the storage space S1, and the like, may be applicable.

A bottom surface of the storage space S1 in the storage body 200 may be inclined such that a discharge port E portion is higher than the other portion.

The ice I in the storage space S1 may be moved to the discharge port E portion by a transferring member 310 included in the transferring and breaking part 300, which will be described later.

If the bottom surface of the storage space S1 is not inclined such that the discharge port E portion is higher than the other portion, the ice I may only be gathered around the discharge port E portion in the storage space S1. If the ice I is only gathered around the discharge port E portion in the storage space S1, a discharge of the ice I through the discharge port E may not be smoothly performed. Also, contacting portions between pieces of the ice I may be melted, such that the pieces of the ice I may be adhered to one another.

However, in the case in which the bottom surface of the storage space S1 is inclined such that the discharge port E portion is higher than the other portion as described above, when a certain amount or more of the ice I is gathered around the discharge port E portion, some of pieces of the ice I may be moved to a portion opposite to the discharge port E by self-weight.

Accordingly, the ice I may be prevented from only being gathered around the discharge port E portion, and a discharge of the ice I through the discharge port E may be smoothly performed. Also, pieces of the ice I may not be adhered to one another.

The ice I may be discharged externally through the discharge port E of the storage body 200.

The storage body 200 may further include a discharging and moving space S2 connecting the storage space S1 and the discharge port E as illustrated in FIG. 5, in addition to the storage space S1 and the discharge port E described above. Through the discharging and moving space S2, as illustrated in FIGS. 7 and 8, unbroken ice Ia that is not broken up by the transferring and breaking part 300, or broken ice Ib that is broken up by the transferring and breaking part 300 may be moved to the discharge port E from the storage space S1.

The storage body 200 may further include a connection and through hole H connecting the storage space S1 and the discharging and moving space S2 as illustrated in FIGS. 1, 2 and 5. As illustrated in FIGS. 7 and 8, the unbroken ice Ia that is not broken up by the transferring and breaking part 300, or the broken ice Ib that is broken up by the transferring and breaking part 300, which is transferred from the storage space S1 to the discharge port E by the transferring and breaking part 300, may enter the discharging and moving space S2 through the connection and through hole H.

The storage body 200 may further include a drain space S3. As illustrated in FIG. 5, the drain space S3 may be extended from the discharging and moving space S2. Water melted from the ice I may flow into and be stored in the drain space S3.

For example, the water melted from the ice I stored in the storage space S1 may flow into the drain space S3 through the connection and through hole H and the discharging and moving space S2, and may be stored in the drain space S3.

As illustrated in FIG. 5, a drain port TD to which a drain line (not illustrated) is connected may be connected to the drain space S3. Accordingly, the water melted from the ice I stored in the drain space S3 may flow into the drain line through the drain port TD and discharged externally.

The storage body 200 may include a main member 210, a first auxiliary member 220, and a second auxiliary member 230 as illustrated in FIG. 2.

The main member 210 may form the storage space S1 and the connection and through hole H. Also, the first auxiliary member 220 may be connected to the main member 210, and form portions of the discharge port E and the discharging and moving space S2. Also, the second auxiliary member 230 may be connected to the main member 210 and the first auxiliary member 220, and may form the discharging and moving space S2 and the drain space S3.

However, a configuration of the storage body 200 may not be particularly limited, and any well-known configuration may be applicable as long as the storage space S1, the discharge port E, the discharging and moving space S2, or the drain space S3, and the like, is able to be formed.

The storage body 200 may have a thermal insulation member 240 to significantly reduce heat transferred between the storage space S1 and the outside as illustrated in FIGS. 1, 2, and 5. Also, the storage space S1 in the storage body 200 may have a noise prevention member 250 to prevent noise.

Transferring and Breaking Part

At least a portion of the transferring and breaking part 300 may be provided in the storage space S1 of the storage body 200. The transferring and breaking part 300 may transfer the ice I in the storage space S1 to the discharge port E portion. The transferring and breaking part 300 may also break the ice I transferred to the discharge port E portion if necessary.

The transferring and breaking part 300 may include the transferring member 310 and a breaking member 320 as illustrated in FIGS. 2 and 3. The transferring member 310 and the breaking member 320 may be configured such that the ice I is not stuck between the transferring member 310 and the breaking member 320 while the ice I is transferred.

Accordingly, a transferring and rotating unit 330 rotating the transferring member 310 to transfer the ice I, for example, which will be described later, or a breaking and rotating unit 340 rotating a rotatable breaking member 321 included in the breaking member 320 to break the ice I, for example, which will be described later, may not be under heavy load to operate or may not stop operating, or the transferring and rotating unit 330 and the breaking and rotating unit 340 may not be broken.

Thus, the transferring and breaking of the ice I may be smoothly performed.

The transferring member 310 may transfer the ice I. The transferring member 310 may rotate to allow the ice I in the storage space S1 to move to the discharge port E portion.

The transferring member 310 may have a transferring wing 311. The transferring wing 311 may have a spiral shape as illustrated in FIGS. 3 and 5. However, a shape of the transferring wing 311 may not be particularly limited, and any shape which can transfer the ice I may be applicable.

The transferring wing 311 may be extended to an end of the transferring member 310 positioned near the discharge port E portion. Accordingly, there may be no gap between the transferring member 310 and an end of the transferring wing 311 positioned near the discharge port E portion. Thus, while the ice I stored in the storage space S1 is transferred by the transferring member 310, the ice I may not fall into a gap between the transferring member 310 and an end of the transferring wing 311 and return, but may be transferred to the end of the transferring member 310 positioned near the discharge port E portion. Accordingly, the ice I remaining in the storage space S1, which may not be transferred by the transferring member 310, may be significantly reduced.

Also, an elastic transformable part 311*a* may be formed on an end of the transferring wing 311 positioned near the discharge port E portion as illustrated in FIG. 3. The elastic transformable part 311*a* may be bent by external force applied by the ice I present between the elastic transformable part 311*a* and the breaking member 320.

Accordingly, even though the ice I transferred by the transferring member 310 is present between the transferring member 310 and the breaking member 320, as the elastic transformable part 311*a* is bent by the external force applied by the ice I, the ice I may not be stuck between the transferring member 310 and the breaking member 320.

The elastic transformable part 311*a* may be formed as the end of the transferring wing 311 positioned near the discharge port E portion is separated from the transferring member 310 by a certain length as illustrated in FIG. 3. However, the configuration to form the elastic transformable part 311*a* may not be particularly limited. Any well known configuration may be applicable as long as the elastic transformable part 311*a* can be bent by external force applied by the ice I. For example, the elastic transformable part 311*a* may be formed of a material having relatively high elasticity and transformability, and the like.

The transferring member 310 may be connected to the transferring and rotating unit 330 including a motor, a gear, a bearing, or the like, and rotate. The transferring and rotating unit 330 may be provided to be connected to the transferring member 310 in a portion of the storage body 200 opposite to the discharge port E as illustrated in FIG. 1.

The breaking member 320 may break the ice I. To allow the ice I transferred by the transferring member 310 to be broken up by the breaking member 320, the breaking member 320 may be positioned subsequent to the transferring member 310 in a discharge port E direction in the storage space S1 as illustrated in FIG. 5.

In other words, the breaking member 320 may be positioned in the discharge port E portion in the storage space S1 in the storage body 200. For example, the breaking member 320 may be positioned above a portion of the connection and through hole H of the storage body 200, which is not opened or closed by a first door 410 included in the door part 400 which will be described later.

Accordingly, as illustrated in FIG. 7, the ice I which is not transferred to the breaking member 320 by the transferring member 310 may not be broken up by the breaking member 320 and may become the unbroken ice Ia, and may pass through the connection and through hole H as the unbroken ice Ia.

Also, as illustrated in FIG. 8, the ice I transferred to the breaking member 320 by the transferring member 310 may be broken up by the breaking member 320 and may become the broken ice Ib, and may pass through the connection and through hole H as the broken ice Ib.

The breaking member 320 may include the rotatable breaking member 321 and a fixed breaking member 322.

The rotatable breaking member 321 may rotate to break the ice I. The rotatable breaking member 321 may be connected to a breaking and rotating shaft 341 included in the breaking and rotating unit 340 including a motor, gear, a bearing, or the like, and rotate. The breaking and rotating unit 340 may be provided in a portion of the storage body 200 near the discharge port E as illustrated in FIG. 1.

The rotatable breaking member 321 may be configured to prevent the ice I from escaping from a breaking position.

Accordingly, while the ice I is broken up by the breaking member 320, the ice I escaping from a break position may not impede the transferring or breaking of the ice I, or may not break the ice storage 100.

Thus, the breaking of the ice I may be smoothly performed.

The rotatable breaking member 321 may be configured such that a plurality of the rotatable breaking members 321 may be connected to the breaking and rotating shaft 341 included in the breaking and rotating unit 340. The number of the rotatable breaking members 321 may be, for example, three, as illustrated in FIGS. 3, and 9 to 11. However, the number of the rotatable breaking member 321 may not be particularly limited, and any number of the rotatable breaking members 321 may be applicable as long as a plurality of the rotatable breaking members 321 are provided.

Some rotatable breaking members 321' among the plurality of rotatable breaking members 321 may form a certain angle with the other rotatable breaking members 321. Some rotatable breaking members 321' may be positioned forward than the other rotatable breaking members 321 by a certain degree in a rotational direction of the breaking and rotating shaft 341.

For example, as illustrated in FIGS. 3 and 9 to 11, at least an outermost rotatable breaking member 321' positioned farthest from the discharge port E among the plurality of rotatable breaking members 321 may be positioned forward than the other rotatable breaking members 321 by a certain degree in a rotational direction of the breaking and rotating shaft 341.

Accordingly, the ice I transferred to a breaking position above the rotatable breaking members 321 and 321' by the transferring member 310 may be prevented from escaping towards other portions, towards the transferring member 310, for example, by the outermost rotatable breaking member 321' as illustrated in FIGS. 9 and 11.

Also, in this case, the ice I may rotate with the rotatable breaking members 321 and 321' and may be broken up in accordance with rotation of the rotatable breaking members 321 and 321' as illustrated in FIGS. 10 and 11.

Thus, the ice I may be broken up while being prevented from escaping from a breaking position by the outermost rotatable breaking member 321', and the breaking of the transferred ice I by the breaking member 320 may be smoothly performed.

The certain degree to which some rotatable breaking members 321' is positioned forward, further than the other rotatable breaking members 321 in a rotational direction of the breaking and rotating shaft 341, may be within a range of 5° to 30°.

When the certain degree to which some rotatable breaking members 321' is positioned forward than the other rotatable breaking members 321 in a rotational direction of the breaking and rotating shaft 341 is less than 5°, some rotatable breaking members 321', the outermost rotatable breaking member 321', for example, may not be able to prevent the ice I from escaping from a breaking position above the rotatable breaking members 321 and 321'.

Also, when the certain degree to which some rotatable breaking members 321' is positioned forward than the other rotatable breaking members 321 in a rotational direction of the breaking and rotating shaft 341 exceeds 30°, the ice I may pass through a space between some rotatable breaking members 321' and the other rotatable breaking members 321 and escape from the breaking position above the rotatable breaking members 321 and 321', or the rotatable breaking members 321 and 321' may impede the entry of the ice I to the breaking position.

Accordingly, in this case as well, some rotatable breaking members 321', the outermost rotatable breaking member 321', for example, may not be able to prevent the ice I from escaping from the breaking position above the rotatable breaking members 321 and 321'.

Thus, a desirable certain degree at which the ice I may be prevented from escaping from the breaking position above the rotatable breaking members 321 and 321' and by which some rotatable breaking members 321' is positioned forward than the other rotatable breaking members 321 in a rotational direction of the breaking and rotating shaft 341, may be within a range from 5° to 30°.

The plurality of rotatable breaking members 321 may be connected to the breaking and rotating shaft 341 with certain gaps.

As illustrated in FIGS. 2 and 3, the breaking and rotating shaft 341 of the breaking and rotating unit 340 may be connected to a shaft connection member MCE. Also, a gap member MG may be provided between the plurality of the rotatable breaking members 321, and the shaft connection member MCE may be inserted into a connection hole HC formed in each of the plurality of rotatable breaking members 321 and the gap members MG.

Accordingly, the plurality of rotatable breaking members 321 may be connected to the breaking and rotating shaft 341 of the breaking and rotating unit 340 with certain gaps.

However, the configuration in which the plurality of rotatable breaking members 321 are connected to the breaking and rotating shaft 341 of the breaking and rotating unit 340 with certain gaps may not be particularly limited, and any well-known configuration may be possible.

In this case, the plurality of rotatable breaking members 321 may respectively pass through spaces among a plurality of the fixed breaking members 322, which will be described later, and may rotate. Accordingly, the ice I transferred by the transferring member 310 to the breaking member 320 may be broken up by rotation of the rotatable breaking member 321 by the breaking and rotating unit 340 and by the fixed breaking member 322.

The rotatable breaking members 321 and 321' may have rotatable breaking wings 321*a* and 321*a*' breaking the ice I along with a fixed breaking wing 322*a* formed on the fixed breaking member 322, which will be described later, as illustrated in FIG. 3.

The rotatable breaking wings 321*a* and 321*a*' may be configured such that a plurality of the rotatable breaking wings 321*a* and 321*a*' may be formed in order from one end and the other end of the rotatable breaking members 321 and 321' in a length direction.

A shape and configuration of the rotatable breaking wings 321*a* and 321*a*' may not be particularly limited, and any well known shape and configuration may be applicable as long as the ice I is able to be broken up in the shape and configuration.

The fixed breaking member 322 may be provided to be fixed to the storage body 200 to break the ice I along with the rotatable breaking member 321. The fixed breaking members 322 may be configured such that a plurality of the fixed breaking members 322 may be provided in the storage body 200 with certain gaps.

For example, a fixed member MF may be provided on both sides of the connection and through hole H of the storage body 200. Also, fixed holes HF may be formed in the fixed member MF with certain gaps. One ends and the other ends of the plurality of the fixed breaking members 322 may be inserted into the fixed holes HF of the fixed member MF, and the plurality of the fixed breaking members 322 may be provided in the storage body 200 with certain gaps.

However, the configuration that the plurality of the fixed breaking members 322 are fixed to the storage body 200 may not be particularly limited, and any well-known configuration may be applicable.

An outermost fixed breaking member 322' positioned closest to the transferring member 310 among the plurality of fixed breaking members 322 may be configured such that ice I is not stuck between the outermost fixed breaking member 322' and the transferring member 310.

For example, as illustrated in FIG. 3, the fixed breaking member 322 other than the outermost fixed breaking member 322' may have the fixed breaking wing 322*a* breaking the ice I, and an escape prevention part 322*b* preventing the ice I from escaping while the ice I is broken up by the fixed breaking wing 322*a*.

Also, only a fixed breaking wing 322*a*' may be formed on the outermost fixed breaking member 322'.

Accordingly, a central portion of the outermost fixed breaking member 322' may have a height lower than heights of central portions of the other fixed breaking members 322, for example.

As described above, as the outermost fixed breaking member 322' does not have the escape prevention part 322*b*, but only have the fixed breaking wing 322*a*, a space greater than the ice I may be formed between the transferring member 310 and the outermost fixed breaking member 322'.

Accordingly, even if the ice I transferred by the transferring member 310 is positioned between the outermost fixed breaking member 322' and the transferring member 310, the ice I may not be stuck between the transferring member 310 and the outermost fixed breaking member 322'.

The fixed breaking wings 322*a* and 322*a*' may be configured such that a plurality of the fixed breaking wings 322*a* and 322*a*' may be formed in order from one end of the fixed breaking members 322 and 322' in a length direction of the fixed breaking members 322 and 322' as illustrated in FIG. 3.

A shape and configuration of the fixed breaking wings 322*a* and 322*a*' may not be particularly limited, and any well-known configuration and shape may be applicable as long as the ice I is able to be broken up in the configuration and shape.

The escape prevention part 322*b* may be formed subsequent to the plurality of fixed breaking wings 322*a* in a length direction of the fixed breaking member 322, and may be greater than the fixed breaking wing 322*a*, as illustrated in FIG. 3.

A shape, a configuration, and a size of the escape prevention part 322*b* may not be particularly limited. Any shape, configuration, and size may be possible as long as the shape and configuration are able to prevent the ice I from escaping while the ice I is broken up, and as long as the size is greater than the size of the fixed breaking wing 322*a*.

Meanwhile, the transferring member 310 and the rotatable breaking member 321 may rotate independently from each other.

Accordingly, as illustrated in FIG. 7, when the ice I is not broken up, only the transferring member 310 may rotate by the transferring and rotating unit 330. Also, as illustrated in FIG. 8, when the ice I is broken up, the transferring member 310 and the rotatable breaking member 321 may rotate by the transferring and rotating unit 330 and the breaking and rotating unit 340, respectively.

The transferring member 310, and the breaking and rotating shaft 341 of the breaking and rotating unit 340 on which the plurality of the rotatable breaking members 321 are connected may be connected to each other to rotate independently from each other.

For example, the transferring member 310 and the breaking and rotating shaft 341 may be connected to each other by an independent rotation connection portion 350.

The independent rotation connection portion 350 may include a first independent rotation connection portion 351 and a second independent rotation connection portion 352 as illustrated in FIG. 3.

The first independent rotation connection portion 351 may be connected to the transferring member 310. For example, a fit connection portion 351*a* formed on the first independent rotation connection portion 351 may be connected to the transferring member 310 by being inserted into the transferring member 310.

The second independent rotation connection portion 352 may be connected to the shaft connection member MCE to which the breaking and rotating shaft 341 of the breaking and rotating unit 340 is connected. For example, an end of the shaft connection member MCE may be connected to the second independent rotation connection portion 352 by being inserted into the second independent rotation connection portion 352.

The second independent rotation connection portion 352 may have an independent rotation part 352*a* having a truncated cone shape. The independent rotation part 352*a* of the second independent rotation connection portion 352 may be provided in an independent rotation space (not illustrated) formed in the first independent rotation connection portion 351 to rotate freely.

Accordingly, the transferring member 310 and the breaking and rotating shaft 341 may rotate independently from each other.

However, the configuration that the transferring member 310 and the breaking and rotating shaft 341 are connected to each other to rotate independently may not be particularly limited, and any well-known configuration may be applicable.

Meanwhile, the transferring and breaking part 300 may be extended such that the transferring member 310 is connected to the breaking and rotating unit 340. Also, the rotatable breaking member 321 may be provided in the extended portion of the transferring member 310, and the rotatable breaking member 321 and the transferring member 310 may rotate together by the breaking and rotating unit 340. In this case, the transferring and rotating unit 330 may not be necessary.

Door Part

The door part 400 may allow the ice I to be discharged through the discharge port E in the storage body 200 as unbroken ice Ia, unbroken by the transferring and breaking part 300, or broken ice Ib, broken up by the transferring and breaking part 300.

The door 400 may include the first door 410 and a first door moving member 420 as illustrated in FIGS. 2 and 4.

The first door 410 may guide the ice I to move to the discharge port E from the storage space S1 in the storage body 200 as unbroken ice Ia or broken ice Ib.

The first door moving member 420 may allow the first door 410 to move among guide positions. Also, the first door moving member 420 may allow the first door 410 to maintain each guide position without departing from the guide positions.

As described above, as the first door 410 is able to maintain each guide position without departing from the guide positions by the first door moving member 420, even if forces other than force allowing the door 410 to rotate among the guide positions is applied to the first door 410, the first door 410 may maintain each guide position without departing from the guide positions.

Thus, the ice I may be guided by the first door 410 and supplied to a user as unbroken ice Ia or broken ice Ib properly.

For example, the ice I may be supplied to a user without being improperly broken up.

The first door 410 may move between a first guide position guiding the ice I not to be broken up by the transferring and breaking part 300 as illustrated in FIG. 7, and a second guide position guiding the ice I to be broken up by the transferring and breaking part 300 as illustrated in FIG. 8.

For example, the first door moving member 420 may be connected to the first door 410, the first door 410 may rotate between the first and second guide positions, and the first door 410 may maintain the first and second guide positions without departing from the first and second guide positions.

Also, the first door moving member 420 may rotate between first and second rotation positions corresponding to the first and second guide positions.

The first door 410 may have a moving guide hole 411. The moving guide hole 411 may be a long hole. A moving guide protrusion 421 formed on the first door moving member 420 may be inserted into the moving guide hole 411 in the first door 410.

Also, as illustrated in FIGS. 6 to 8, when the first door moving member 420 rotates between the first and second rotation positions, the moving guide protrusion 421 on the first door moving member 420 may move along the moving guide hole 411 in the first door 410, and the first door 410 may accordingly rotate between the first and second guide positions.

Also, in the first rotation position, the moving guide protrusion 421 on the first door moving member 420 may be positioned on one end of the moving guide hole 411 in the first door 410, and in the second rotation position, the moving guide protrusion 421 on the first door moving member 420 may be positioned on the other end of the moving guide hole 411.

Accordingly, the first door 410 rotated to the first guide position may be maintained in the first guide position without departing from the first guide position, and the first door 410 rotated to the second guide position may be maintained in the second guide position without departing from the second guide position.

The first door 410 may further include a stop groove 412. By the stop groove 412, the first door 410 may be stopped by the first door moving member 420 in the first guide position. Accordingly, the first door 410 rotated to the first guide position may be maintained in the first guide position without departing from the first guide position.

The first door 410 and the first door moving member 420 may be provided to be rotatable in the discharging and moving space S2 formed in the storage body 200 to connect the storage space S1 and the discharge port E.

In this case, the moving guide protrusion 421 on the first door moving member 420 described above, and a rotating shaft 422 formed on the first door moving member 420, provided to be rotatable in the discharging and moving space S2, may be spaced apart from each other by a certain distance.

Accordingly, the first door 410 rotated to the first guide position may be maintained in the first guide position without departing from the first guide position, and the first door 410 rotated to the second guide position may be maintained in the second guide position without departing from the second guide position.

The first door 410 rotated to the first guide position by the first door moving member 420 may guide the ice I to not be transferred to the breaking member 320 of the transferring and breaking part 300 as illustrated in FIG. 7. Accordingly, the ice I may not be broken up by the breaking member 320.

Also, the first door 410 rotated to the second guide position by the first door moving member 420 may guide the ice I to be transferred to the breaking member 320 of the transferring and breaking part 300 as illustrated in FIG. 8. Accordingly, the ice I may be broken up by the breaking member 320.

The first door 410 may open and close a portion of the connection and through hole H of the storage body 200. Also, the breaking member 320 of the transferring and breaking part 300 described above may be positioned above a different portion of the connection and through hole H, which is neither opened nor closed by the first door 410.

Accordingly, in the first guide position as illustrated in FIG. 7 where the first door 410 opens a portion of the connection and through hole H, the ice I may not be transferred to the breaking member 320 of the transferring and breaking part 300 by the first door 410, and the ice may pass through the connection and through hole H of the storage body 200 as unbroken ice Ia, not broken up by the breaking member 320. The unbroken ice Ia passing through the connection and through hole H as above may be guided by the first door 410 and moved to the discharge port E of the storage body 200.

Also, in the second guide position where the first door 410 closes a portion of the connection and through hole H as illustrated in FIG. 8, the ice I may be transferred to the breaking member 320 by the first door 410, and the ice I may pass through the connection and through hole H as broken ice Ib, broken up by the breaking member 320. The broken ice Ib passing through the connection and through hole H as above may be guided by the first door 410 and moved to the discharge port E of the storage body 200.

In this case, the first door 410 may include an opening and closing surface 413 opening and closing a portion of the connection and through hole H, a guiding surface 414 guiding unbroken ice Ia or broken ice Ib to be moved to the discharge port E of the storage body 200. Also, the moving guide hole 411 described above may be formed in a length direction of the guiding surface 414.

Also, a shape of a cross-section of the opening and closing surface 413 in the first door 410 may correspond to a shape of a cross-section of a bottom surface of the storage space S1 in the storage body 200. If the shape of a cross-section of a bottom surface of the storage space S1 is concave downwardly, for example, the shape of a cross-section of the opening and closing surface 413 in the first door 410 may also be concave downwardly.

Accordingly, the ice I may be smoothly transferred to the breaking member 320 by the opening and closing surface 413 in the first door 410.

Also, a shape of a cross-section of the guiding surface 414 in the first door 410 may configured such that unbroken ice Ia or broken ice Ib may be smoothly moved to the discharge port E. For example, a shape of a cross-section of the guiding surface 414 may also correspond to a shape of a cross-section of a bottom surface in the storage space S1 in the storage body 200.

However, a shape of a cross-section of the guiding surface 414 in the first door 410 may not be particularly limited, and any shape may be possible as long as unbroken ice Ia or broken ice Ib is able to be smoothly moved to the discharge port E.

The guiding surface 414 in the first door 410 may be positioned to be inclined to the discharge port E portion of the storage body 200 in the first and second guide positions. Accordingly, the movement of unbroken ice Ia or broken ice Ib to the discharge port E by the guiding surface 414 may be performed easily.

The first door 410 may rotate about a lower portion. In this case, the opening and closing surface 413 in the first door 410 may form a top surface of the first door 410, and the guiding surface 414 in the first door 410 may form one side portion of the first door 410.

However, the rotation center of the first door 410 may not be particularly limited, and any portion of the first door 410 may become the rotation center.

Meanwhile, the first door moving member 420 may be connected to a door moving member rotating unit 440 including a motor, and the like, and rotate. However, a handle may be connected to the first door moving member 420, and the first door moving member 420 may be rotated manually by a user.

The door part 400 may further include the second door 430.

The second door 430 may open and close the discharge port E of the storage body 200.

When the second door 430 closes the discharge port E, unbroken ice Ia or broken ice Ib moved to the discharge port E by the first door 410 may not be discharged externally through the discharge port E.

Also, when the second door 430 opens the discharge port E, unbroken ice Ia or broken ice Ib moved to the discharge port E by the first door 410 may be discharged externally through the discharge port E.

The second door 430 may rotate along an outer side of the discharge port E and open the discharge port E.

Also, in the state in which the second door 430 closed the discharge port E, the second door 430 may reach a stopper JS formed in the discharge port E.

Accordingly, a user's hand may be prevented from contacting the breaking member 320, that is, the rotatable breaking member 321 of the breaking member 320, through the discharging and moving space S2 and the connection and through hole H in the storage body 200 as the second door 430 rotates along an inner side of the discharge port E.

In other words, in the case of the structure in which the second door 430 rotates along an inner side of the discharge port E and is opened, in the non-operational state in which the discharge of the ice I through the discharge port E is not performed, the second door 430 may be opened by external force, and a user's hand may contact the breaking member 320, which may lead to a safety accident.

However, as in the exemplary embodiment, if the second door 430 rotates along an outer side of the discharge port E and opens the discharge port E, and the second door 430 is prevented from rotating along an inner side of the discharge port E, the safety accident, an injury to a user's hand by the rotatable breaking member 321, may be prevented.

Also, the second door 430 may be inclined to the drain space S3 in the storage body 200 when the discharge port E is closed.

Accordingly, water melted from the ice I, flowing along the second door 430 or the first door 410 through the connection and through hole H of the storage body 200, may flow into the drain space S3, and the water melted from the ice I may be prevented from being discharged externally through the discharge port E of the storage body 200.

The second door 430 may rotate about an upper portion. However, the rotation center of the second door 430 may not be particularly limited, and any portion of the second door 430 may become the rotation center.

The second door 430 may be connected to a second door rotating unit 450 including a motor and so on, and rotate.

The configuration of the door 400 may not be particularly limited, and any well-known configuration such as the configuration that only one door is included, and the like, may be applicable as long as the ice I is allowed to be discharged through the discharge port E as unbroken ice Ia or broken ice Ib, unbroken or broken up by the transferring and breaking part 300.

According to the aforementioned exemplary embodiments, the ice transferred by the transferring member may be prevented from becoming stuck between the transferring member and the breaking member breaking the ice, the transferring and breaking of the ice may be smoothly performed without being interrupted, and the remaining ice which is not transferred by the transferring member may be significantly reduced.

The ice storage as described above is not limited to the features described in the exemplary embodiments set forth herein, but overall or some of the exemplary embodiments may be selectively combined and configured to implement a variety of modifications.

The invention claimed is:

1. An ice storage, comprising: a storage body having a storage space in which ice is stored and a discharge port through which ice is discharged externally; a transferring and breaking part of which at least a portion is provided in the storage space, the transferring and breaking part transferring the ice in the storage space to the discharge port and breaking the transferred ice as required; and a door part allowing the ice to be discharged through the discharge port as unbroken ice or broken ice unbroken or broken up by the transferring and breaking part, wherein the transferring and breaking part comprises a transferring member and a breaking member comprising a plurality of fixed breaking members, wherein, among the plurality of fixed breaking members, an outermost fixed breaking member positioned closest to the transferring member is configured to prevent ice from being stuck between the outermost fixed breaking member and the transferring member while being transferred, and wherein a fixed breaking member other than the outermost fixed breaking member is provided with a fixed breaking wing and an escape prevention part configured to prevent ice from escaping while the ice is broken up by the fixed breaking member.

2. The ice storage of claim 1, wherein the breaking member is disposed subsequent to the transferring member in a discharge port direction in the storage space to allow the ice transferred by the transferring member to be broken up by the breaking member.

3. The ice storage of claim 2, wherein the transferring member rotates to allow the ice in the storage space to be transferred to the discharge port.

4. The ice storage of claim 3, wherein the transferring member is provided with a transferring wing, and the transferring wing is provided with an elastic transformable part, bendable by external force applied by ice present between the transferring member and the breaking member, on an end of the transferring wing positioned near the discharge port.

5. The ice storage of claim 4, wherein the transferring wing is extended to an end of the transferring member positioned near the discharge port.

6. The ice storage of claim 4, wherein the elastic transformable part is formed as the end of the transferring wing positioned near the discharge port is separated from the transferring member by a certain length.

7. The ice storage of claim 4, wherein the transferring wing has a spiral shape.

8. The ice storage of claim 2, wherein the breaking member further comprises a rotatable breaking member.

9. The ice storage of claim 8, wherein the plurality of the fixed breaking members are provided in the storage body with certain gaps.

10. The ice storage of claim 8, wherein the outermost fixed breaking member is only provided with the fixed breaking wing therein.

11. The ice storage of claim 1, wherein the fixed breaking wing is configured such that a plurality of the fixed breaking wings are formed in order from one end of the fixed breaking member in a length direction of the fixed breaking member.

12. The ice storage of claim 11, wherein the escape prevention part is formed subsequent to the plurality of fixed breaking wings in a length direction of the fixed breaking member.

13. The ice storage of claim 12, wherein the escape prevention part is larger than the fixed breaking wing.

14. The ice storage of claim 1, wherein a central portion of the outermost fixed breaking member has a height lower than heights of central portions of the other fixed breaking members.

15. The ice storage of claim 1, wherein the rotatable breaking member rotates by a breaking and rotating unit.

16. The ice storage of claim 15, wherein the rotatable breaking member is configured such that a plurality of the rotatable breaking members are connected to one another with certain gaps in a breaking and rotating shaft included in the breaking and rotating unit to respectively pass through spaces among the plurality of fixed breaking members and rotate.

17. The ice storage of claim 16, wherein the rotatable breaking member is provided with a rotatable breaking wing breaking ice along with the fixed breaking wing.

18. The ice storage of claim 17, wherein the rotatable breaking wing is configured such that a plurality of the rotatable breaking wings are formed in order from one end and the other end of the rotatable breaking member in a length direction of the rotatable breaking member.

* * * * *